US008520882B2

(12) United States Patent
Hiwatashi

(10) Patent No.: US 8,520,882 B2
(45) Date of Patent: Aug. 27, 2013

(54) SPEAKER TERMINAL MOUNT STRUCTURE AND SPEAKER UNIT

(75) Inventor: Hideki Hiwatashi, Yao (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 47 days.

(21) Appl. No.: 13/355,068

(22) Filed: Jan. 20, 2012

(65) Prior Publication Data

US 2012/0195456 A1 Aug. 2, 2012

(30) Foreign Application Priority Data

Jan. 28, 2011 (JP) ..... 2011-016673

(51) Int. Cl.
*H04R 25/00* (2006.01)

(52) U.S. Cl.
USPC ..... 381/386; 381/393; 381/395

(58) Field of Classification Search
USPC ..... 381/386, 392–395, 189, 152, 431
See application file for complete search history.

(56) References Cited

U.S. PATENT DOCUMENTS

2005/0094842 A1 5/2005 Hashiba

FOREIGN PATENT DOCUMENTS

JP 2005-136708 A 5/2005
JP 2005-260775 A 9/2005

*Primary Examiner* — Suhan Ni
(74) *Attorney, Agent, or Firm* — Westerman, Hattori, Daniels & Adrian, LLP

(57) ABSTRACT

A speaker terminal mount structure has a frame having a slit, and a terminal supported by the frame when inserted into the slit. The slit has a shape including two first side support sections, and at least one second side support section abutting on a second surface and positioned on an inner side of a region sandwiched between the two first side support sections when viewed from a direction in which the terminal is inserted. Assuming that a first virtual straight line is formed by connecting the two first side support sections, and a second virtual straight line extends in parallel to the first straight line at a distance smaller than a thickness of the terminal from the first straight line in a first direction, the second side support section is positioned in a second direction with respect to the second straight line.

9 Claims, 9 Drawing Sheets

SPEAKER TERMINAL MOUNT STRUCTURE AND SPEAKER UNIT

This nonprovisional application is based on Japanese Patent Application No. 2011-016673 filed on Jan. 28, 2011 with the Japan Patent Office, the entire contents of which are hereby incorporated by reference.

BACKGROUND OF THE INVENTION

1. Field of the Invention

The present invention relates to a speaker terminal mount structure and a speaker unit, and more particularly, to a speaker terminal mount structure in which a terminal is inserted into a slit of a frame, and a speaker unit having the same.

2. Description of the Related Art

A speaker is mounted in a mobile information terminal such as a mobile phone, smartphone, PDA (Personal Digital Assistants), game machine, or personal computer. According to this speaker, a terminal of a speaker unit is electrically connected to a set side substrate (device side circuit substrate). This terminal is electrically connected to a voice coil of the speaker unit by a lead. Thus, the speaker unit and the set side substrate are electrically connected.

Conventionally, a speaker having a structure in which this terminal is inserted into a slit of the frame has been disclosed. As this kind of speaker, Japanese Patent Laying-Open No. 2005-136708 discloses a speaker apparatus in which one inner periphery edge section of an opening of a spring terminal engages with a clinch section of an L-shaped hooked protrusion section of a frame, and an L-shape insertion section of the spring terminal is inserted into a hole of the frame, whereby the spring terminal is fixed to the frame.

Furthermore, Japanese Patent Laying-Open No. 2005-260775 discloses a speaker apparatus in which a metal-made spring terminal is fixed to a resin-made frame by press-fitting a plurality of folded pieces of the metal-made spring terminal into a plurality of fitting holes on the resin-made frame.

According to the speaker apparatus disclosed in the Japanese Patent Laying-Open No. 2005-136708, the opening of the spring terminal is inserted into the clinch section of the L-shaped hooked protrusion section of the frame, and the L-shaped insertion section of the spring terminal is inserted into the hole of the frame. Therefore, it is necessary to form the hole of the frame so as to be larger than the L-shaped insertion section of the spring terminal in order to mount the spring terminal in the frame. Therefore, after the spring terminal has been mounted in the frame, the insertion section of the spring terminal moves in the hole of the frame. Therefore, a position of the spring terminal is not stable.

According to the speaker apparatus disclosed in Japanese Patent Laying-Open No. 2005-260775, since the folded pieces of the metal-made spring terminal are not in parallel with each other, it is necessary to form the fitting hole of the resin-made frame so as to be larger than the folded piece. Therefore, after mounted, the folded piece of the metal-made spring terminal is moved in the fitting hole of the resin-made frame. As a result, a position of the metal-made spring terminal is not stable.

As described above, when the position of the spring terminal is not stable, the lead electrically connected to the spring terminal could be broken due to the movement of the spring terminal.

SUMMARY OF THE INVENTION

A speaker terminal mount structure according to the present invention has a frame having a slit, and a terminal supported by the frame when inserted into the slit. The slit has a shape including two first side support sections which abut on a first surface of the terminal, and at least one second side support section which abuts on a second surface opposed to the first surface of the terminal and is positioned on an inner side of a region sandwiched between the two first side support sections when viewed from a direction in which the terminal is inserted. Assuming that a first virtual straight line is formed by connecting the two first side support sections, and a second virtual straight line extends in parallel to the first straight line at a distance smaller than a thickness of the terminal, from the first straight line in a first direction extending from the first surface to the second surface, the second side support section is positioned in a second direction opposite to the first direction, with respect to the second straight line.

A speaker unit according to the present invention includes the above speaker terminal mount structure, a diaphragm, a voice coil mounted in the diaphragm, a lead electrically connected to the voice coil, and a magnet arranged so as to be opposed to the voice coil. The frame supports the magnet and the diaphragm, and the terminal is electrically connected to the voice coil when electrically connected to the lead.

The foregoing and other features and aspects of the present invention will become more apparent from the following detailed description of the present invention when taken in conjunction with the accompanying drawings.

DESCRIPTION OF THE PREFERRED EMBODIMENTS

Hereinafter, an embodiment of the present invention will be described with reference to the drawings.

First Embodiment

First, a configuration of a speaker unit according to a first embodiment of the present invention will be described.

Figure 1:
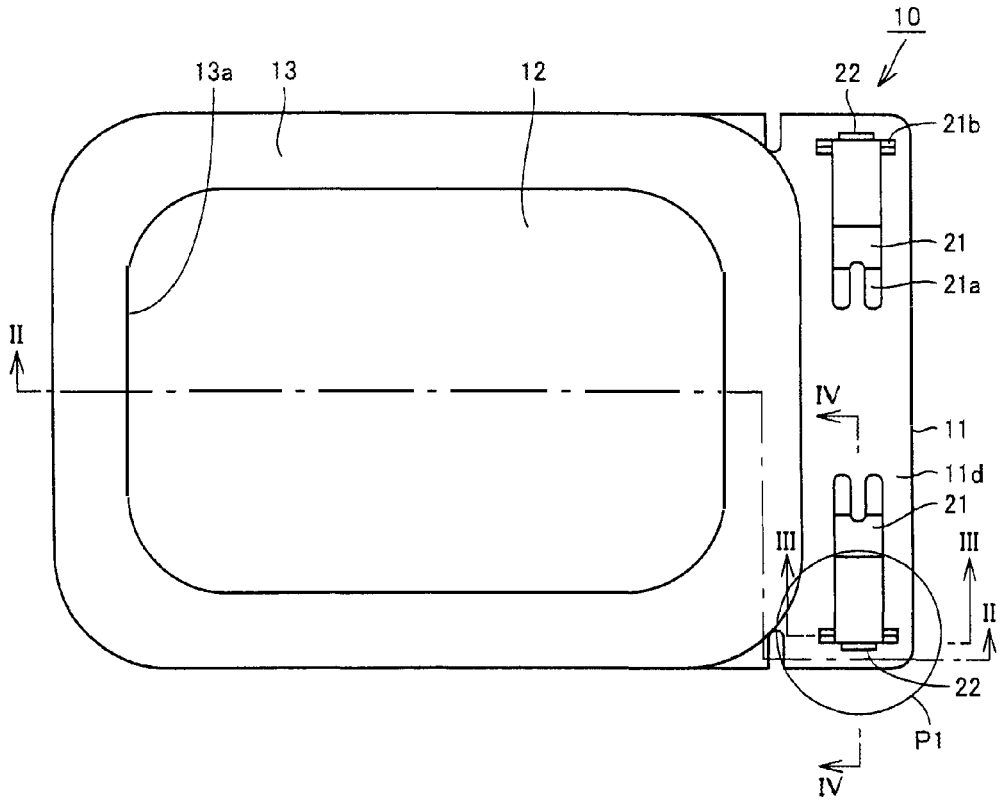
FIG. 1 is a schematic top view of a speaker unit in a first embodiment of the present invention.
Figure 2:
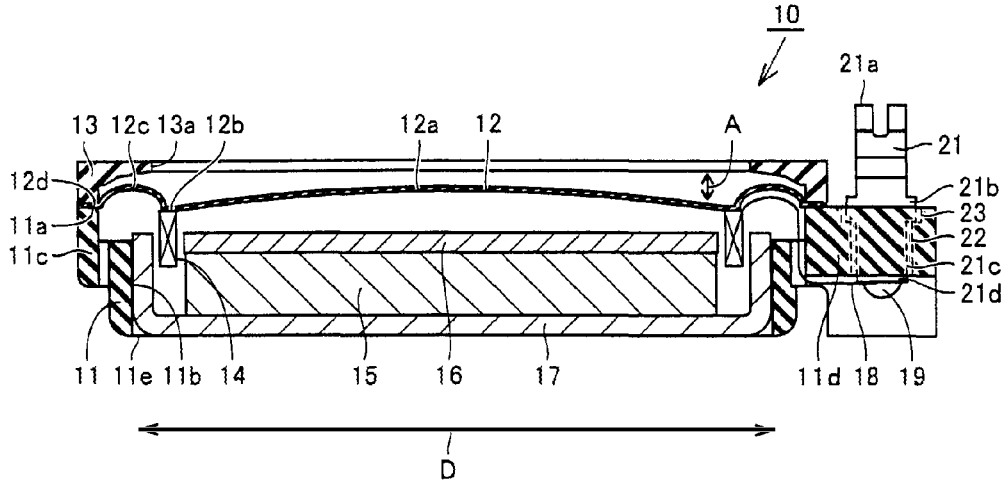
FIG. 2 is a schematic cross-sectional view taken along a line II-II in FIG. 1.

With reference to FIGS. 1 and 2, a speaker unit 10 mainly has a frame 11, a diaphragm 12, a frame cover 13, a voice coil 14, a magnet 15, a plate 16, a yoke 17, a lead 18, and a terminal 21.

Frame 11 mainly has a support section 11*a*, an inner periphery section 11*b*, an outer periphery section 11*c*, a terminal mount section 11*d*, and a slit 22. Frame 11 has a rear hole 11*e*. Support section 11*a* is provided on an upper surface of outer periphery section 11*c*. An outer periphery end of diaphragm 12 is supported by support section 11*a*, so that diaphragm 12 is vibratably supported by frame 11. A difference in level may be provided between support section 11*a* and inner periphery section 11*b*.

Two slits 22 are provided in outer periphery section 11*c*. Each of two slits 22 is formed so as to penetrate terminal mount section 11*d* in a direction in which frame 11 overlaps with frame cover 13. Terminal 21 is supported by each of two slits 22. Two terminals 21 are inserted into slits 22, respectively, so that they are supported by frame 11. Terminal 21 is formed by press molding a metal plate. Terminal 21 is formed of a material such as stainless or titanium copper. A thickness of terminal 21 is about 0.1 mm to 0.2 mm. As terminal 21, a spring terminal may be used.

Figure 3:
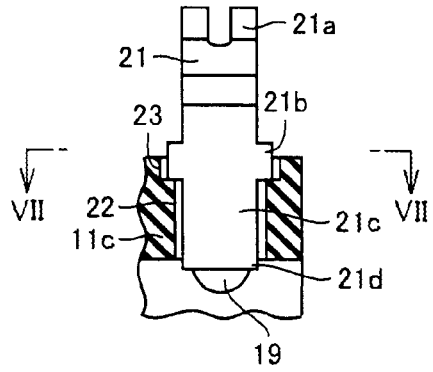
FIG. 3 is a schematic partial cross-sectional view taken along a line III-III in FIG. 1.
Figure 4:
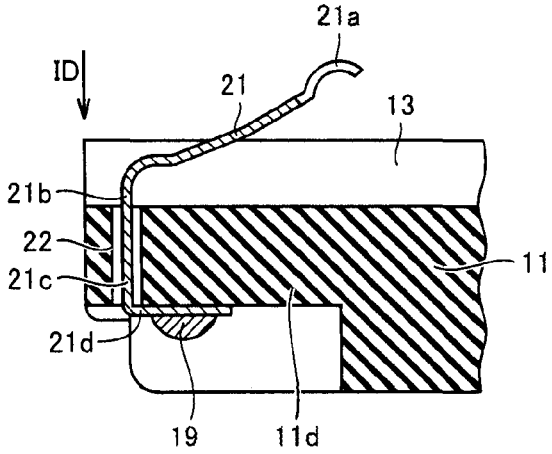
FIG. 4 is a schematic partial cross-sectional view taken along a line IV-IV.

With reference to FIGS. 3 and 4, terminal 21 mainly has a projection section 21*a*, a protrusion section 21*b*, an insertion section 21*c*, and a folding section 21*d*. Projection section 21*a* is provided so as to project from frame 11. Protrusion section 21*b* can engage with frame 11 in a direction ID in which terminal 21 is inserted into slit 22. A concave section 23 which can receive protrusion section 21*b* is provided in terminal mount section 11*d* of frame 11. According to this embodiment, protrusion section 21*b* is received by concave section 23. Insertion section 21*c* is provided in slit 22. Folding section 21*d* is folded along a lower surface of terminal mount section 11*d*.

Figure 5:
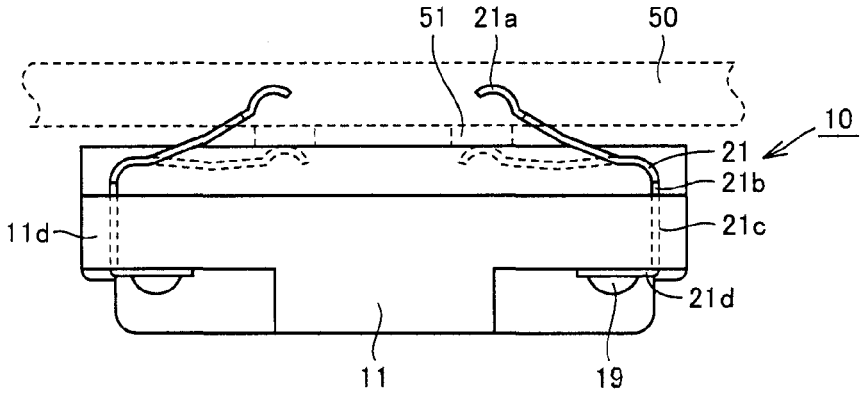
FIG. 5 is a schematic side view of the speaker unit in the first embodiment of the present invention.

With reference to FIG. 5, when projection section 21*a* of terminal 21 abuts on a substrate side terminal 51 of a set side substrate (device side circuit substrate) 50 under an elastically deformed condition, speaker unit 10 is electrically connected to set side substrate 50 through terminal 21.

In addition, with reference FIGS. 1 and 2 again, frame 11 is configured to support yoke 17 having magnet 15 in inner periphery section 11*b*. Yoke 17 is supported by frame 11 so as to be exposed on rear hole 11*e*. Outer periphery section 11*c* is formed to be continued to outer periphery side of support section 11*a*. Frame 11 is formed into a track shape in a planar view. Here, the track shape means a shape formed such that both ends of two straight lines are connected with arcs. Frame 11 is formed of a material such as a resin. In addition, frame 11 may have a part formed of a metal.

Diaphragm 12 is configured by a thin plate so as to be able to vibrate in vertical direction (shown by an arrow A in FIG. 2). Diaphragm 12 has a center vibration section 12*a*, a voice coil mount section 12*b*, an edge section 12*c*, and a frame mount section 12*d*. Center vibration section 12*a* is provided in a center of diaphragm 12. Center vibration section 12*a* is formed into an arc shape so as to project in an opposite direction of magnet 15 when viewed from a cross-section of diaphragm 12 in a radial direction D.

Voice coil mount section 12*b* is provided on an outer periphery side of center vibration section 12*a*. Voice coil mount section 12*b* is provided between center vibration section 12*a* and edge section 12*c*. Voice coil mount section 12*b* is circularly provided so as to surround center vibration section 12*a*. Voice coil mount section 12*b* is provided to mount voice coil 14. Voice coil mount section 12*b* is formed so as to be flat when viewed from the cross-section of diaphragm 12 in radial direction D.

Edge section 12*c* is provided on an outer periphery side of voice coil mount section 12*b*. Frame mount section 12*d* is provided on an outer periphery side of edge section 12*c*. Frame mount section 12*d* is mounted in support section 11*a* of frame 11. Frame mount section 12*d* is circularly provided so as to surround edge section 12*c*. Frame mount section 12*d* is formed so as to be flat when viewed from the cross-section of diaphragm 12 in radial direction D.

Diaphragm 12 is formed into the track shape in a planar view, for example. Diaphragm 12 is made of a material such as PET (polyethylene terephthalate), PEN (polyethylene naphthalate), or PEI (polyether imide).

Voice coil 14 is mounted in diaphragm 12 such that an upper surface of voice coil 14 is fixed to voice coil mount section 12*b* of diaphragm 12. Voice coil 14 is formed into the track shape, for example. Lead 18 is electrically connected to voice coil 14.

Magnet 15 is arranged in an inner periphery side of voice coil 14 at a distance from an inner periphery of voice coil 14 (internal magnet type). Magnet 15 is arranged so as to be opposed to voice coil 14. Yoke 17 has a section (outer periphery side section) arranged on an outer periphery side of voice coil 14 at a distance from an outer periphery of voice coil 14, and a section (lower side section) arranged on a lower side of voice coil 14 and magnet 15.

Yoke 17 is fixed by engaging with inner periphery section 11*b* of frame 11, in an outer periphery of the outer periphery side section. The lower side section of yoke 17 is arranged at a distance from the lower surface of voice coil 14. Magnet 15 is arranged in a center of the lower side section of yoke 17. Plate 16 is arranged on an upper surface of magnet 15. These magnet 15, plate 16, and yoke 17 constitute a magnet circuit.

Figure 6:
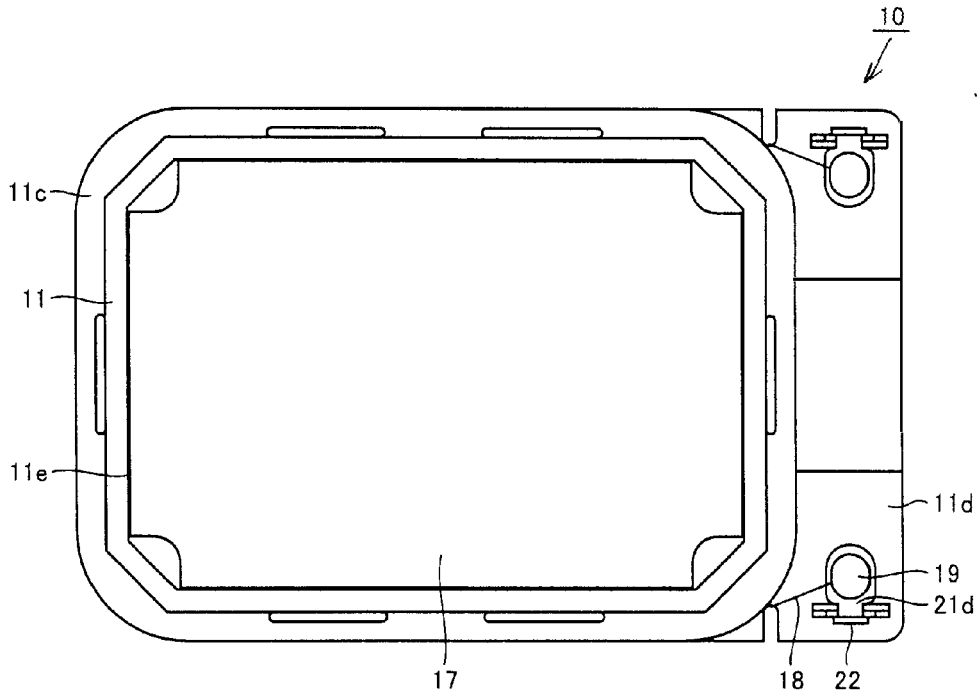
FIG. 6 is a schematic bottom view of the speaker unit in the first embodiment of the present invention.

With reference to FIGS. 2 and 6, terminal 21 is connected to lead 18 with a solder 19. Lead 18 electrically connected to voice coil 14 is connected to folding section 21*d* of terminal 21 with soldering. When terminal 21 is electrically connected to lead 18, it is electrically connected to voice coil 14.

Next, engagement between the terminal and the slit will be described further in detail. In addition, in FIGS. 7 and 8, a degree of curvature of the terminal is larger than in reality for convenience of the description. Similarly, in FIGS. 12 to 14 below, the degree of curvature of the terminal is larger than in reality for convenience of the description.

Figure 7:
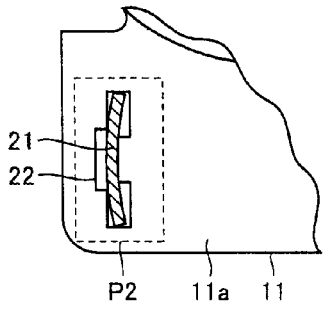
FIG. 7 is a schematic top view showing an engagement state between a slit and a terminal in a part P1 in FIG. 1.
Figure 8:
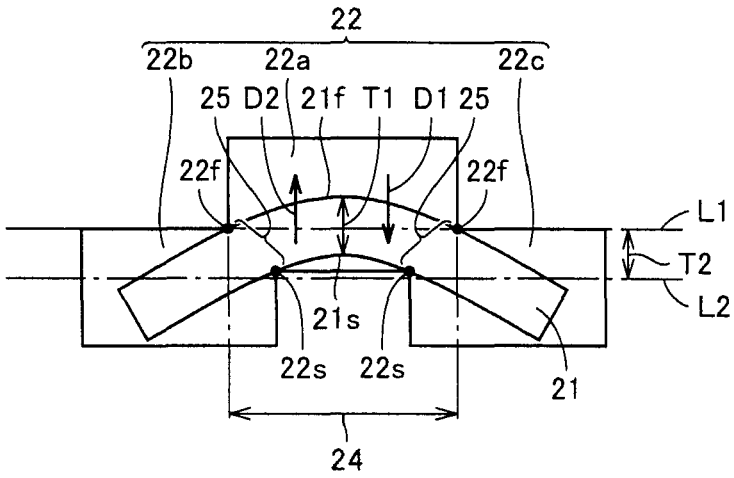
FIG. 8 is a schematic partial enlarged top view showing a part P2 in FIG. 7.

With reference to FIGS. 7 and 8, slit 22 has a shape having two first side support sections 22*f* abutting on a first surface 21*f* of terminal 21, and two second side support sections 22*s* abutting on a second surface 21*s* opposed to first surface 21*f* of terminal 21 when viewed from a direction ID in which terminal 21 is inserted. Second side support section 22*s* is positioned on an inner side of a region 24 sandwiched between two first side support sections 22*f*. That is, second side support sections 22*s* are positioned on an inner side of two first side support sections 22*f*, in region 24 sandwiched between two first side support sections 22*f*. That is, second side support sections 22*s* are positioned so as not to be provided on two first side support sections 22*f*. In addition, the number of second side support section 22*s* may be one.

It is assumed that a first virtual straight line L1 is formed by connecting two first side support sections 22*f*. In addition, it is assumed that a second virtual straight line L2 extends in parallel to first straight line L1. Second straight line L2 is positioned on a side of a first direction D1 extending from first surface 21*f* to second surface 21*s* of terminal 21, with respect to first straight line L1. Second straight line L2 is positioned at a distance T2 which is smaller than a thickness T1 of terminal 21, from first straight line L1. Second side support section 22*s* is positioned on a side of a second direction D2 which is an opposite direction of first direction D1, with respect to second straight line L2. That is, second side support section 22*s* is positioned on second straight line L2, or on the side of second direction D2, with respect to second straight line L2. According to this embodiment, second side support section 22*s* is positioned in first direction D1 with respect to first straight line L1.

Thus, distance T2 as a vertical line between first straight line L1 and second straight line L2 is smaller than thickness T1 of terminal 21. It is preferable that distance T2 as the vertical line between first straight line L1 and second straight line L2 is set to be smaller than thickness T1 of terminal 21 within a range of 5% to 15%. It is especially preferable that distance T2 as the vertical line between first straight line L1 and second straight line L2 is set to be smaller than thickness T1 of terminal 21 by 10%.

Thus, second side support section 22*s* is positioned in first direction D1 with respect to second straight line L2. Therefore, a distance as a vertical line between first straight line L1 and second side support section 22*s* is smaller than thickness T1 of terminal 21. As a result, terminal 21 is not supported by slit 22 in a straight line state along first straight line L1. That is, terminal 21 is supported by slit 22 in a cured state.

The shape of slit 22 will be further described. Slit 22 has a first hole section 22*a*, and a second hole section 22*b* and a third hole section 22*c* provided on both sides of first hole section 22*a*. First hole section 22*a* and second hole section 22*b* are connected to each other such that a difference in level is generated. In addition, first hole section 22*a* and third hole section 22*c* are connected to each other such that a difference in level is generated. A squeeze section 25 is provided in each of a connection part between first hole section 22*a* and second hole section 22*b*, and a connection part between first hole section 22*a* and third hole section 22*c*.

Terminal 21 is supported by slit 22 in the curved state. That is, since second side support section 22*s* is positioned in second direction D2 which is the opposite direction of first direction D1, with respect to second straight line L2, terminal 21 cannot pass between first side support section 22*f* and second side support section 22*s* in the straight line state. Thus, terminal 21 is supported by first side support section 22*f* and second side support section 22*s* in the curved state.

Next, a method for mounting the terminal in frame will be described.

Figure 9:
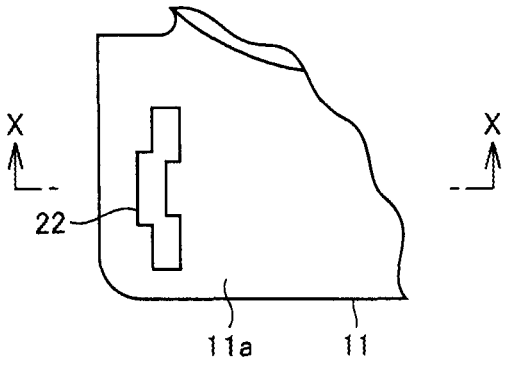
FIG. 9 is a schematic top view showing a shape of the slit in the part P1 in FIG. 1.
Figure 10:
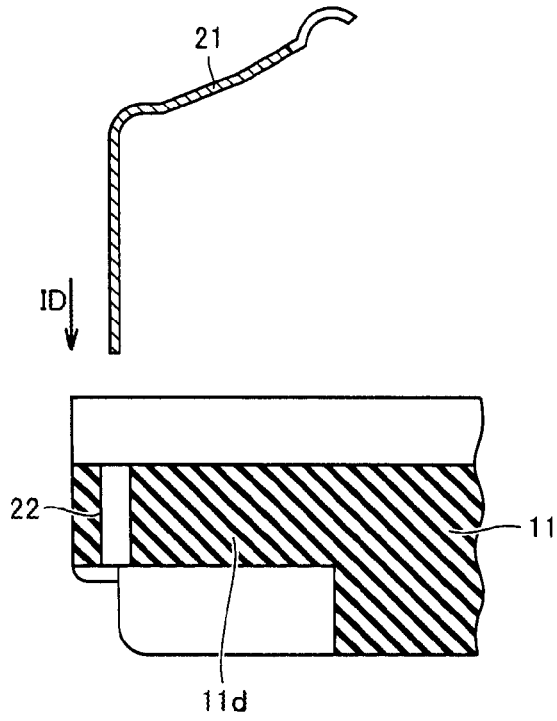
FIG. 10 is a schematic partial cross-sectional view showing a state before the slit is inserted into the terminal, and corresponding to the cross-sectional position in FIG. 4.
Figure 11:
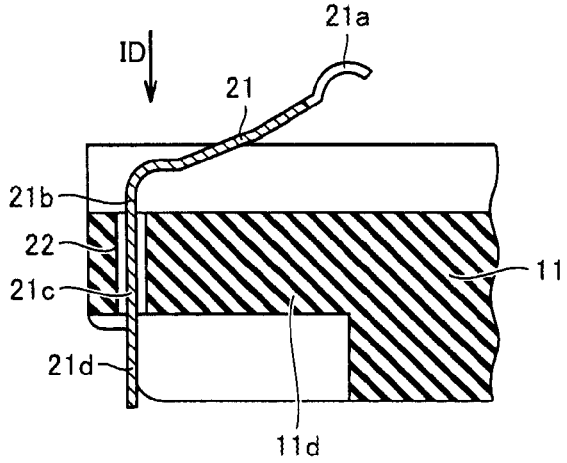
FIG. 11 is a schematic partial cross-sectional view showing a state after the slit has been inserted into the terminal, and corresponding to the cross-sectional position in FIG. 4.

With reference FIG. 9, frame 11 having slit 22 is prepared. With reference to FIG. 10, terminal 21 is prepared so as to be inserted into slit 22. With reference to FIG. 11, terminal 21 is inserted into slit 22. At this time, insertion section 21*c* is positioned in slit 22. According to this embodiment, since protrusion section 21*b* engages with frame 11, terminal 21 is positioned by protrusion section 21*b* in direction ID in which the terminal is inserted. Then, folding section 21*d* is folded along a lower surface of terminal mount section 11*d*. Thus, terminal 21 is inserted into the slit and supported by frame 11.

Next, an operation of the speaker unit according to this embodiment will be described.

In speaker unit 10, a magnetic flux generated from magnet 15 is guided by plate 16 and yoke 17, and converges to a void of voice coil 14, whereby a magnetic field is generated. Thus, when an alternate current flows in voice coil 14, voice coil 14 vertically vibrates by the alternate current flowing in voice coil 14 and the magnetic field generated from magnet 15, based on Fleming's left-hand rule. Therefore, diaphragm 12 mounted in voice coil 14 vibrates. Thus, an electric signal (alternate current) is converted to a sound (vibration).

Figure 12:
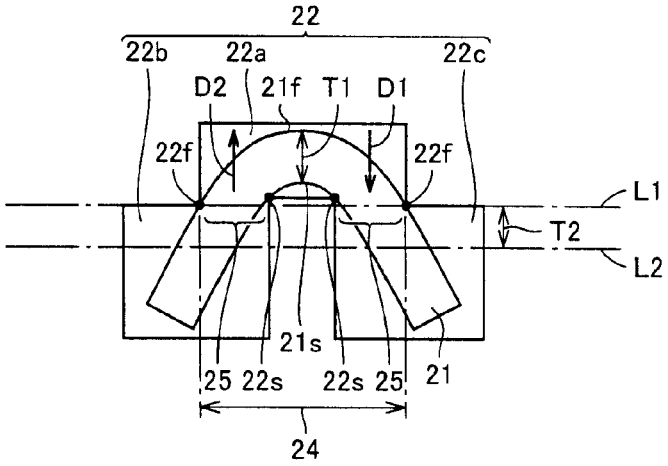
FIG. 12 is a schematic partial enlarged top view showing a variation 1 of the first embodiment of the present invention, and corresponding to the planar position in FIG. 8.

In the above, the description has been made of the case where second side support section 22*s* is positioned in first direction D1 with respect to first straight line L1, but the speaker terminal mount structure in this embodiment is not limited to this. With reference to FIG. 12, according to a variation 1 of the speaker mount structure in this embodiment, second side support section 22*s* is positioned in second direction D2 with respect to first straight line L1.

Figure 13:
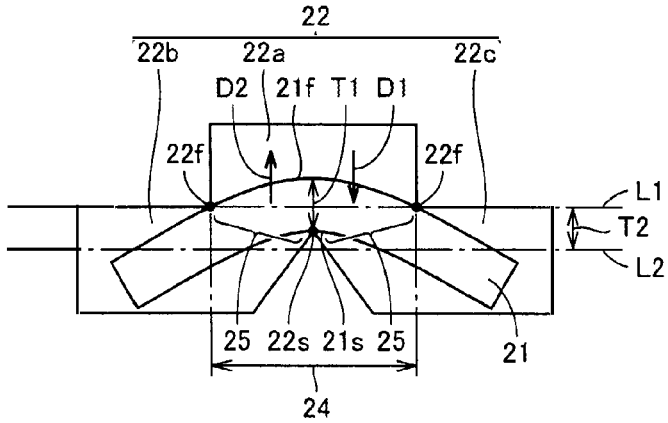
FIG. 13 is a schematic partial enlarged top view showing a variation 2 of the first embodiment of the present invention, and corresponding to the planar position in FIG. 8.

In the above, the description has been made of the case where two second side support sections 22*s* are provided, but the speaker terminal mount structure in this embodiment is not limited to this. With reference to FIG. 13, according to a variation 2 of the speaker mount structure in this embodiment, the number of second side support section 22*s* is singular.

Figure 14:
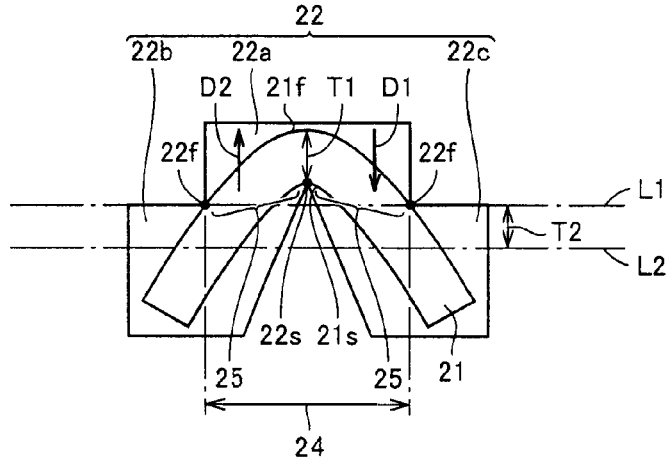
FIG. 14 is a schematic partial enlarged top view showing a variation 3 of the first embodiment of the present invention, and corresponding to the planar position in FIG. 8.

In variation 2, the description has been made of the case where second side support section 22*s* is positioned in first direction D1 with respect to first straight line L1, but similar to variation 1, second side support section 22*s* may be positioned in second direction D2 with respect to first straight line L1. With reference to FIG. 14, according to a variation 3 of the speaker mount structure in this embodiment, single second side support section 22*s* is positioned in second direction D2 with respect to first straight line L1.

Figure 15:
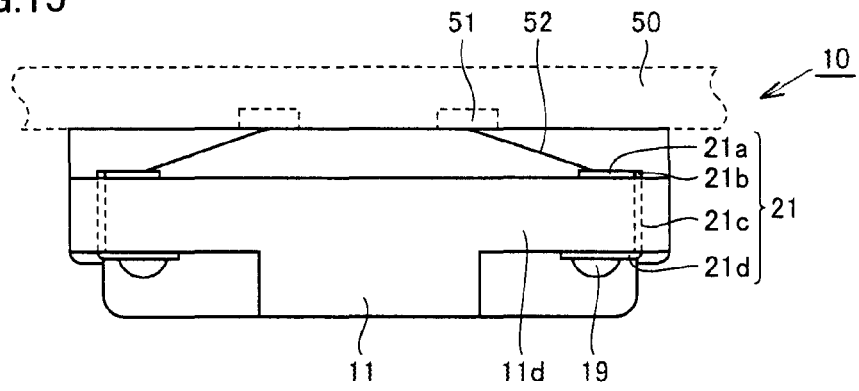
FIG. 15 is a schematic side view showing a variation 4 of the first embodiment of the present invention, and corresponding to the planar position in FIG. 5.

In the above, the description has been made of the case where terminal 21 is the spring terminal, but terminal 21 is not limited to this. With reference to FIG. 15, projection section 21*a* of terminal 21 may be provided to follow an upper surface of terminal mount section 11*d*. In this case, projection 21*a* of terminal 21 may be electrically connected to substrate side terminal 51 of set side substrate (device side circuit substrate) 50 with soldering through a wire 52.

In addition, in the above, the description has been made of the internal magnet type speaker unit, but this embodiment can be applied to an external type speaker unit 10 in which magnet 15 is arranged on the outer periphery side of voice coil 14. In addition, this embodiment can be applied to a horizontal type speaker unit in which voice coil 14 is formed so as to become large in a width direction instead of a thickness direction and arranged on a first surface of magnet 15.

In addition, in the above, the description has been made of the case where speaker unit 10 is formed into the track shape in the planar view, but it may be formed into a circular shape or an elliptic shape in the planar view.

Next, an operation effect in this embodiment will be described compared with a comparison example.

Figure 16:
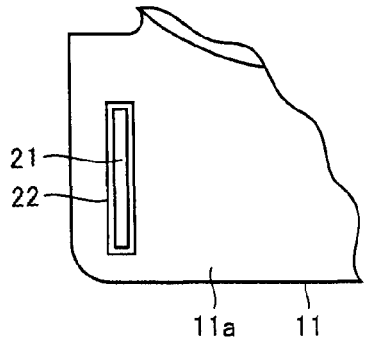
FIG. 16 is a schematic top view showing an engagement state between a slit and a terminal in a comparison example 1, and corresponding to the planar position in FIG. 7.
Figure 17:
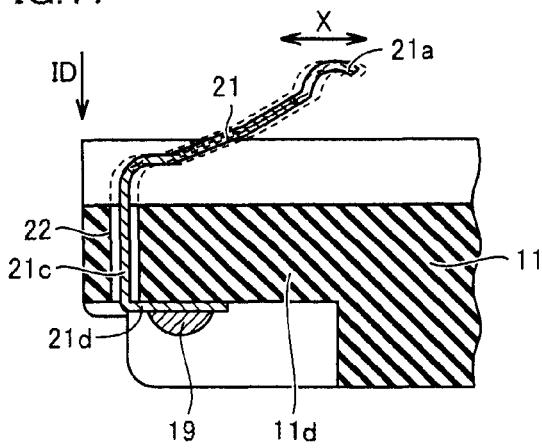
FIG. 17 is a schematic partial cross-sectional view showing a state in which the terminal moves in a width direction of the slit in the comparison example 1, and corresponding to the cross-sectional position in FIG. 4.

With reference to FIG. 16, according to a comparison example 1, a shape of slit 22 is formed into a linear shape. In the case of comparison example 1, a dimension of terminal 21 has to be smaller than a dimension of slit 22 to insert terminal 21 into slit 22. With reference to FIG. 17, since the dimension of terminal 21 is smaller than the dimension of slit 22, terminal 21 moves in slit 22 in a width direction of slit 22 (shown by an arrow X in the drawing). Therefore, a position of terminal 21 is not stable in the width direction of slit 22 (shown by arrow X in the drawing).

Figure 18:
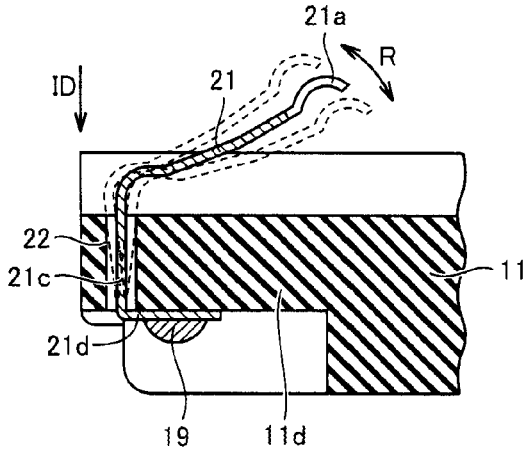
FIG. 18 is a schematic partial cross-sectional view showing a state in which the terminal pivots in the slit in the comparison example 1, and corresponding to the cross-sectional position in FIG. 4.

In addition, with reference to FIG. 18, since the dimension of terminal 21 is smaller than the dimension of slit 22, terminal 21 pivots around folding section 21*d* in slit 22. Therefore, the position of terminal 21 is not stable in a pivot direction of terminal 21 (shown by an arrow R in the drawing).

Figure 19:
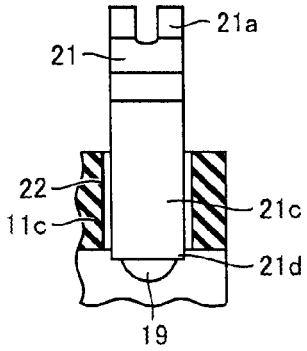
FIG. 19 is a schematic partial cross-sectional view showing an engagement state between the slit and the terminal in the comparison example 1, and corresponding to the cross-sectional position in FIG. 3.
Figure 20:
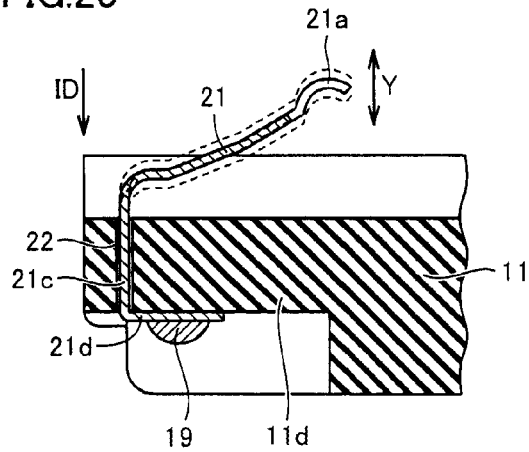
FIG. 20 is a schematic partial cross-sectional view showing a state in which the terminal moves in a depth direction of the slit in the comparison example 1, and corresponding to the cross-sectional position in FIG. 4.

Furthermore, with reference to FIG. 19, according to comparison example 1, terminal 21 does not have protrusion section 21*b* shown in FIG. 3. Moreover, frame 11 does not have concave section 23 shown in FIG. 3. Therefore, terminal 21 is not positioned by protrusion section 21*b*, in direction ID in which terminal 21 is inserted. With reference to FIG. 20, since the dimension of terminal 21 is smaller than the dimension of slit 22, terminal 21 moves in slit 22 in a depth direction of slit 22 (shown by an arrow Y in the drawing). Therefore, the position of terminal 21 is not stable in the depth direction of slit 22 (shown by arrow Y in the drawing).

Figure 21:
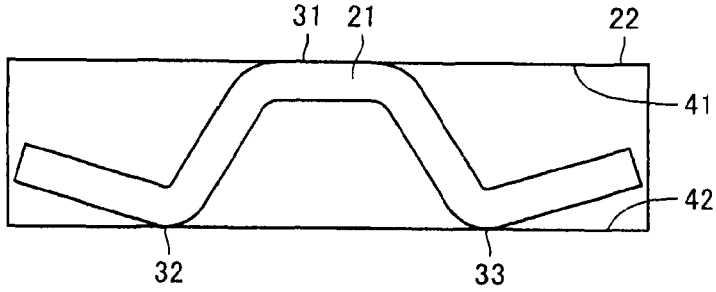
FIG. 21 is a schematic partial enlarged top view showing an engagement state between a slit and a terminal in a comparison example 2, and corresponding to the planar position in FIG. 8.

With reference to FIG. 21, according to a comparison example 2, slit 22 is formed into the linear shape. In addition, terminal 21 is formed into a convex shape by press molding. According to comparison example 2, terminal 21 mainly has a first curved section 31, a second curved section 32, and a third curved section 33. After terminal 21 has been inserted into slit 22, terminal 21 is biased toward slit 22 by elastic deformation of terminal 21. Thus, under the condition that terminal 21 is biased, first curved section 31 is in contact with first side surface 41 of slit 22, and second curved section 32 and third curved section are in contact with a second side surface 42.

According to comparison example 2, when terminal 21 is formed into the concave shape, the shape is likely to vary. Therefore, according to comparison example 2, the shape is likely to vary due to the press molding, compared with the case where terminal 21 has the linear shape. Terminal 21 is not stably fixed to slit due to the variation in shape due to the press molding. Therefore, the position of terminal 21 is not stable.

Meanwhile, according to the speaker terminal mount structure in this embodiment, assuming that first virtual straight line L1 is formed by connecting two first side support sections 22*f*, and the second virtual straight line extends in parallel to the first virtual straight line at distance T2 which is smaller than thickness T of terminal 21, from first virtual straight line L1 in first direction D1, second side support section 22*s* is positioned in second direction D2 with respect to second straight line L2. Therefore, terminal 21 can be supported under the condition that it is curved by two first side support section 22*f* and second side support section 22*s*. Therefore, terminal 21 can be biased toward slit 22 by the elastic force of terminal 21. Thus, terminal 21 can be stably fixed to slit 22 with own elastic force. Since terminal 21 is stably fixed to slit 22, the breakdown of lead 18 due to a movement of terminal 21 can be prevented.

In addition, since terminal 21 can be stably fixed to slit 22, the position of terminal 21 can be stabilized. Thus, a contact point between terminal 21 and set side substrate (device side circuit substrate) 50 can be prevented from shifting. Thus, a conduction defect due to the shift of the contact point can be prevented.

In addition, since terminal 21 can be stably fixed to slit 22, a chatter noise due to the movement of terminal 21 can be prevented from being generated. Thus, a stable sound can be generated.

In addition, in the case where slit 22 is formed into the linear shape as described in comparison example 1, a width dimension of a die for forming slit 22 corresponds to a width dimension of the linear shape, so that the width dimension of the die becomes thin. Therefore, strength of the die is lowered. Thus, there is a limit to a width dimension of slit 22. Therefore, when terminal 21 is thin, terminal 21 cannot be stably fixed to slit 22.

Meanwhile, according to this embodiment, since terminal 21 can be supported under the condition that it is curbed by two first side support section 22*f* and second side support section 22*s*, a width dimension of slit 22 can be large compared to the case where terminal 21 has the linear shape. Therefore, strength of a die can be ensured. Thus, in this respect also, terminal 21 can be stably fixed to slit 22.

In addition, according to the speaker terminal mount structure in this embodiment, since second side support section 22*s* is positioned in first direction D1 with respect to first straight line L1, a degree of the curvature of terminal 21 curbed by two first side support section 22*f* and second side support section 22*s* can be small. Thus, terminal 21 can be easily inserted into slit 22.

In addition, according to the speaker terminal mount structure in this embodiment, second side support section 22*s* may be positioned in second direction D2 with respect to first straight line L1. Thus, terminal 21 can be supported under the condition that it is largely curved by two first side support section 22*f* and second side support section 22*s*. Therefore, terminal 21 can be strongly biased toward slit 22 by the elastic force of terminal 21. Thus, terminal 21 can be strongly fixed to slit 22.

In addition, according to the speaker terminal mount structure in this embodiment, at least one second side support section 22*s* is provided as single second side support section 22*s*. Therefore, a configuration of slit 22 can be simplified.

In addition, according to the speaker terminal mount structure in this embodiment, at least one second side support section 22*s* is provided as two second side support sections 22*s*. Therefore, terminal 21 can be supported at four or more points. Terminal 21 can be sandwiched between first side support section 22*f* and second side support section 22*s*, on a first end and a second end sides of terminal 21. Thus, terminal 21 can be further stably fixed to slit 22.

In addition, according to the speaker terminal mount structure in this embodiment, terminal 21 has protrusion section 21*b* which can engage with frame 11, in direction ID in which terminal 21 is inserted into slit 22. Therefore, when protrusion section 21*b* engages with frame 11, terminal 21 can be positioned in direction ID in which terminal 21 is inserted into slit 22. Thus, terminal 21 can be stably fixed to slit 22 in direction ID in which terminal 21 is inserted into slit 22.

In addition, according to the speaker terminal mount structure in this embodiment, frame 11 has concave section 23 which can receive protrusion section 21*b*. Therefore, when protrusion section 21*b* is received by concave section 23, terminal 21 can be further stably positioned in direction ID in which terminal 21 is inserted into slit 22. Thus, terminal 21 can be stably fixed to slit 22 in direction ID in which terminal 21 is inserted into slit 22.

In addition, according to the speaker terminal mount structure in this embodiment, terminal 21 is the spring terminal. Since terminal 21 can be stably fixed to slit 22, a position of a contact point of spring terminal can be stabilized. Therefore, the contact point between terminal 21 and substrate side terminal 51 of set side substrate 50 can be prevented from shifting. Thus, the conduction defect due to the shift of the contact point can be prevented from being generated. In addition, since terminal 21 can be stably fixed to slit 22, a support point of the spring terminal can be stabilized when a load is applied to the spring terminal. Thus, performance of the spring terminal can be stabilized.

In addition, the speaker unit in this embodiment includes the above speaker terminal mount structure, and terminal 21 is electrically connected to voice coil 14 when it is electrically connected to lead 18. Since terminal 21 can be stably fixed to slit 22 due to the speaker terminal mount structure, breakdown of lead 18 caused by the movement of terminal 21 can be prevented.

Second Embodiment

First, a configuration of a mobile information terminal according to a second embodiment of the present invention will be described. In this embodiment, a mobile information terminal having speaker unit 10 according to the first embodiment will be described.

Figure 22:
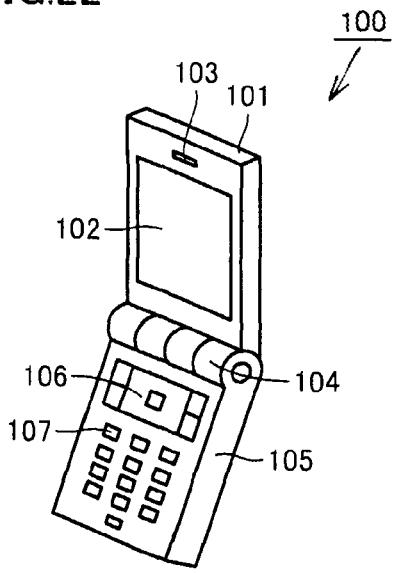
FIG. 22 is a schematic perspective view of a mobile information terminal in a second embodiment of the present invention.
Figure 23:
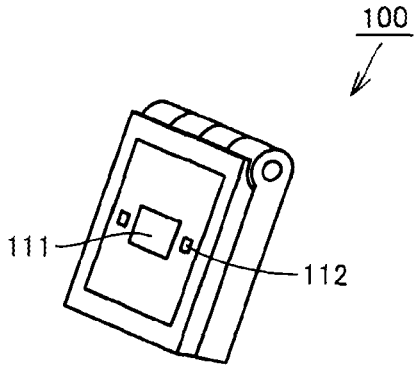
FIG. 23 is a schematic perspective view showing a folded state of the mobile information terminal in the second embodiment of the present invention.

With reference to FIGS. 22 and 23, a mobile information terminal 100 in this embodiment serves as a mobile phone and mainly includes an upper casing 101, a display section 102, a sound ejection hole 103, a hinge section 104, a lower casing 105, an operation button 106, a numeric button 107, a display section 111, a sound ejection hole 112, and speaker unit 10 (not shown) according to the first embodiment.

With reference to FIG. 22, display 102 is provided on a front surface of upper casing 101. Sound ejection hole 103 is formed in a first end side of the front surface of upper casing 101. Hinge section 104 is formed in the second end side of upper casing 101. Hinge section 104 is formed in the first end side on lower casing 105. Upper casing 101 and lower casing 105 are connected by hinge section 104 such that they can be opened and closed. Operation button 106 is formed on a front surface of lower casing 105 on a side of hinge section 104. Numeric buttons 107 are formed toward an opposite side of hinge 104 from operation button 106.

With reference to FIG. 23, display section 111 is provided on a back surface of upper casing 101. Sound ejection hole 112 is formed beside display section 111.

Speaker unit 10 (not shown) in the first embodiment is provided in an inner side of upper casing 101. Sound is generated from speaker unit 10 to an outside of mobile information terminal 100 through sound ejection holes 103 and 112 mainly.

Next, an operation effect of the mobile information terminal in this embodiment will be described.

According to mobile information terminal 100 in this embodiment, since mobile information terminal 100 includes speaker unit 10 according to the first embodiment, the same operation effect as that of the first embodiment is provided.

In addition, the description has been made of the case where the mobile information terminal is the mobile phone in this embodiment, but it may be a smartphone, PDA (Personal Digital Assistants), game machine, or a personal computer.

In addition, the above embodiments can be appropriately combined.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A speaker terminal mount structure comprising:

a frame having a slit; and a terminal supported by said frame when inserted into said slit; wherein said slit has a shape including:

two first side support sections which abut on a first surface of said terminal; and at least one second side support section which abuts on a second surface opposed to said first surface of said terminal, and is positioned in an inner side of a region sandwiched between said two first side support sections when viewed from a direction in which said terminal is inserted, and based on an assumption that a first virtual straight line is formed by connecting said two first side support sections, and a second virtual straight line extends in parallel to said first straight line at a distance smaller than a thickness of said terminal from said first straight line in a first direction extending from said first surface to said second surface, said second side support section is positioned in a second direction opposite to said first direction with respect to said second straight line.

2. The speaker terminal mount structure according to claim 1, wherein said second side support section is positioned in said first direction with respect to said first straight line.

3. The speaker terminal mount structure according to claim 1, wherein said second side support section is positioned in said second direction with respect to said first straight line.

4. The speaker terminal mount structure according to claim 1, wherein said at least one second side support section is provided as said single second side support section.

5. The speaker terminal mount structure according to claim 1, wherein said at least one second side support section is provided as said two second side support sections.

6. The speaker terminal mount structure according to claim 1, wherein said terminal has a protrusion section capable of engaging with said frame, in a direction in which said terminal is inserted into said slit.

7. The speaker terminal mount structure according to claim 6, wherein said frame has a concave section capable of receiving said protrusion section.

8. The speaker terminal mount structure according to claim 1, wherein said frame is a spring terminal.

9. A speaker unit comprising:

the speaker terminal mount structure according to claim 1;

a diaphragm;

a voice coil mounted in said diaphragm;

a lead electrically connected to said voice coil; and a magnet arranged so as to be opposed to said voice coil; wherein said frame supports said magnet and said diaphragm, and said terminal is electrically connected to said voice coil when electrically connected to said lead.

* * * * *